US010236639B2

(12) United States Patent
Hayasaka et al.

(10) Patent No.: US 10,236,639 B2
(45) Date of Patent: Mar. 19, 2019

(54) ATTACHMENT STRUCTURE OF SHIELD CONNECTOR FOR DIRECTLY MOUNTING ON DEVICE

(71) Applicant: YAZAKI CORPORATION, Tokyo (JP)

(72) Inventors: Noboru Hayasaka, Shizuoka (JP); Yasuhiro Tanaka, Shizuoka (JP); Hiroaki Ono, Shizuoka (JP); Toru Suzuki, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/039,409

(22) Filed: Jul. 19, 2018

(65) Prior Publication Data

US 2019/0052029 A1 Feb. 14, 2019

(30) Foreign Application Priority Data

Aug. 9, 2017 (JP) ..... 2017-153849

(51) Int. Cl.

| | |
|---|---|
| ***H01R 13/659*** | (2011.01) |
| ***H01R 13/6596*** | (2011.01) |
| ***H01R 13/6581*** | (2011.01) |
| ***H01R 13/74*** | (2006.01) |
| ***H01R 13/6591*** | (2011.01) |

(52) U.S. Cl.

CPC ..... *H01R 13/6596* (2013.01); *H01R 13/6581* (2013.01); *H01R 13/6591* (2013.01); *H01R 13/74* (2013.01)

(58) Field of Classification Search

CPC ..... H01R 13/6596

See application file for complete search history.

(56) References Cited

U.S. PATENT DOCUMENTS

| | | | | |
|---|---|---|---|---|
| 5,064,388 | A * | 11/1991 | Paladel | H01R 13/6596 174/359 |
| 5,112,251 | A * | 5/1992 | Cesar | H01R 13/6596 439/607.41 |
| 2011/0195603 | A1* | 8/2011 | Fujiwara | H01R 13/6596 439/607.28 |
| 2015/0140851 | A1* | 5/2015 | Wang | H01R 13/5221 439/275 |
| 2015/0295363 | A1* | 10/2015 | Wang | H01R 13/5205 439/578 |

(Continued)

FOREIGN PATENT DOCUMENTS

JP 2013-229139 A 11/2013

*Primary Examiner* — James Harvey

(74) *Attorney, Agent, or Firm* — Kenealy Vaidya LLP

(57) ABSTRACT

An attachment structure for directly attaching a shield connector to an opening formed in a metal casing is provided. A shield connector for directly mounting on a device is attached to an opening formed in a metal casing. A connector housing is fastened to the casing with bolts from outside the casing. The opening of the metal casing has a diameter-enlarged portion formed in an end portion of the opening in an outside direction of the casing to be enlarged toward the outside direction. The shield shell has a contact piece at an end portion of the shield shell, and the contact piece is housed in and contacts with the diameter-enlarged portion in a state that the shield connector is attached to the opening.

4 Claims, 6 Drawing Sheets

(56) References Cited

U.S. PATENT DOCUMENTS

| | | | | |
|---|---|---|---|---|
| 2015/0325963 | A1* | 11/2015 | Chen | H01R 13/6596 439/573 |
| 2015/0357748 | A1* | 12/2015 | Ohmori | H01R 24/52 439/578 |
| 2018/0287292 | A1* | 10/2018 | Furuya | H01R 13/516 |
| 2018/0287293 | A1* | 10/2018 | Furuya | H01R 13/5202 |

* cited by examiner

ATTACHMENT STRUCTURE OF SHIELD CONNECTOR FOR DIRECTLY MOUNTING ON DEVICE

CROSS-REFERENCES TO RELATED APPLICATIONS

This application is a based on and claims priority from Japanese Patent Applications No. 2017-153849 filed on Aug. 9, 2017, the entire contest of which are incorporated herein by reference.

BACKGROUND OF THE INVENTION

1. Technical Field

The present invention relates to an attachment structure of a shield connector for directly mounting on a device.

2. Background Art

Conventionally, a shield connector for directly mounting on a device is known (see Patent document 1). The shield connector is attached to an opening formed in a metal casing. Such shield connector for directly mounting on a device is equipped with a resin connector housing which has a terminal housing portion for housing a terminal and is fastened to a casing with bolts and a metal shield shell which is attached to the connector housing and surrounds the terminal housing portion.

In such shield connector for directly mounting on a device, the shield shell has a contact piece having springiness. When the connector housing is fastened to the casing with bolts, the contact piece of the shield shell is pressed against the casing due to its springiness. As a result, the shield connector for directly mounting on a device is fixed to the casing and the shield shell and the casing are electrically connected to each other via the resulting contact.

Patent document 1: JP-A-2013-229139

SUMMARY OF THE INVENTION

In the shield connector for directly mounting on a device disclosed in Patent document 1, a contact is formed in such a manner that the contact piece having springiness is pressed against the outer surface of the casing. Since such a contact that is formed by utilizing springiness requires strong contact pressure to stabilize the shield circuit, work of attaching the shield connector for directly mounting on a device to the casing is prone to be rendered difficult. In particular, in shield connectors for directly mounting on a device of a type that the connector housing is inserted into the casing so as to penetrate through the opening of the casing, the insertion force may be made so strong as to lower the efficiency of insertion work.

FIG. 10 is a sectional view showing a shield connector 100 for directly mounting on a device according to a comparative example. As shown in FIG. 10, a contact piece 131 of a shield shell 130 is provided in the rear of a connector housing 110 of the shield connector 100 for directly mounting on a device. The shield connector 100 for directly mounting on a device is inserted into an opening O of the casing C by a worker from outside the casing C and then fixed to the casing C by bolt fastening. As shown in FIG. 10, the contact piece 131 is brought into elastic contact with an inner wall IW of the opening O.

In this shield connector 100 for directly mounting on a device, in order to attain a stable shielding effect, the contact piece 131 needs to be kept in strong contact with the casing C. For this reason, it is preferable that the contact piece 131 provides a strong elastic force (spring reaction force). However, since in this structure the contact piece 131 is in elastic press-contact with the inner wall IW of the opening O, the insertion force for attaching the shield connector 100 for directly mounting on a device to the opening O is made too strong when the spring reaction force of the contact piece 131 is increased. Thereby, the efficiency of insertion work in the shield connector 100 for directly mounting on a device shown in FIG. 10 is reduced.

The present invention has been made in view of the above circumstances, and an object of the present invention is therefore to provide an attachment structure of a shield connector for directly mounting on a device capable of increasing the efficiency of work of inserting the shield connector for directly mounting on a device into an opening of a casing.

The present invention provides an attachment structure for directly attaching a shield connector to an opening formed in a metal casing. The attachment structure includes a shield connector for directly mounting on a device; and a metal casing having the opening. The shield connector includes a non-conductive connector housing inserted in the opening and having a terminal housing portion that houses a conductive terminal; and a metal shield shell which is attached to the connector housing and surrounds the terminal housing portion. The connector housing is fastened to the casing with a bolt from outside the casing. The opening has a diameter-enlarged portion formed in an end portion of the opening in an outside direction of the casing to be enlarged toward the outside direction. The shield shell has a contact piece at an end portion of the shield shell, and the contact piece is housed in and contacts with the diameter-enlarged portion in a state that the shield connector is attached to the opening.

In the attachment structure of the shield connector for directly mounting on a device according to the present invention, the opening has the diameter-enlarged portion that is an outside-end opening of the casing. The contact piece that is an end portion of the shield shell is set in the diameter-enlarged portion of the opening so as to be in contact with the diameter-enlarged portion in a state that the shield connector for directly mounting on a device is attached to the opening of the casing. Thus, the contact piece comes into contact with the diameter-enlarged portion only at the last stage of insertion of the shield connector for directly mounting on a device into the opening or at the time of bolt fastening. As a result, the efficiency of work of insertion of the shield connector for directly mounting on a device into the opening of the casing can be made higher than in a case that the contact piece is kept in press-contact with the opening or the like all the time from the initial stage of the insertion to the bolt fastening.

In the above attachment structure of the shield connector for directly mounting on a device, it is preferable that one of the contact piece of the shield shell and the diameter-enlarged portion of the casing has a tapered surface formed in a part to be contact with the other of the contact piece of the shield shell and the diameter-enlarged portion of the casing. The tapered surface is pressed against the other of the contact piece of the shield shell and the diameter-enlarged portion of the casing when the connector housing is fixed to the casing by bolt fastening. Further, it is preferable that both of the contact piece of the shield shell and the diameter-enlarged portion of the casing have tapered surfaces respectively.

In this attachment structure of the shield connector, one of the contact piece of the shield shell and the diameter-enlarged portion of the casing has the tapered surface formed in a part to be contact with the other of the contact piece of the shield shell and the diameter-enlarged portion of the casing. The tapered surface is pressed against the other of the contact piece of the shield shell and the diameter-enlarged portion of the casing when the connector housing is fixed to the casing by bolt fastening. Further, both of the contact piece of the shield shell and the diameter-enlarged portion of the casing have tapered surfaces respectively, and thereby the tapered surfaces come into contact with each other when the connector housing is fixed to the casing by bolt fastening. Since in this manner the tapered surface is pressed against what is opposed to it utilizing the force of bolt fastening, a wedge effect is produced and the contact pressure at the contact portion can be made so high as to make the shielding effect stable. Furthermore, when the connector housing is fixed to the casing by bolt fastening, press-contact occurs by virtue of the wedge effect produced by the tapered surface, whereby during the bolt fastening the contact portion receives a strong pressing force and hence the connector housing is prevented from rotation. Since the contact pressure at the contact portion is increased and the connector housing is prevented from rotation, it is not necessary to use a member that is dedicated to stopping of rotation of the connector housing.

In the above attachment structure of the shield connector for directly mounting on a device, it is preferable that one of the contact piece and the diameter-enlarged portion is formed with a projection which projects toward the other of the contact piece and the diameter-enlarged portion.

In this attachment structure of the shield connector for directly mounting on a device, one of the contact piece and the diameter-enlarged portion is formed with the projection that projects toward the other of the contact piece and the diameter-enlarged portion. As a result, a proper contact pressure can be secured even if the displacement of the contact piece is increased and the insertion stroke is shortened.

The present invention can provide an attachment structure of a shield connector for directly mounting on a device capable of preventing the force for inserting the connector housing into the opening of the casing from becoming too strong and stopping rotation of the connector housing when it is fastened with bolts.

DESCRIPTION OF THE PREFERRED EMBODIMENT

Figure 1:
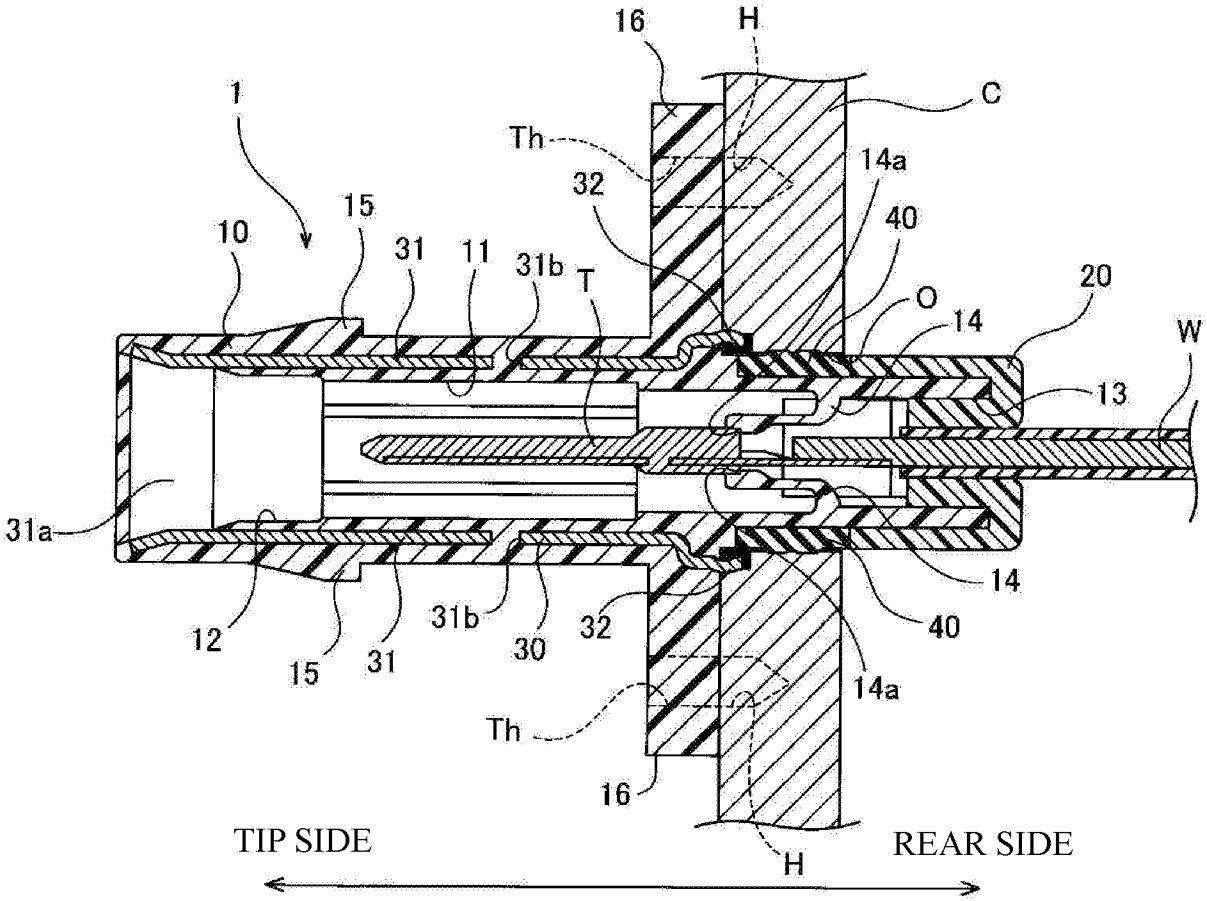
FIG. 1 is a sectional view showing an attachment structure of a shield connector for directly mounting on a device according to an embodiment of the present invention.

The present invention will be hereinafter described by way of a preferred embodiment. The present invention is not limited to the following embodiment, and modifications can be made as appropriate without departing from the spirit and scope of the invention. In the following embodiment, part of the components will not be described or shown in the drawings. However, it goes without saying that known techniques can be applied as appropriate to the details of techniques that will not be described or shown in the drawings in such a range as not to be contradictory to the following description.

Figure 2:
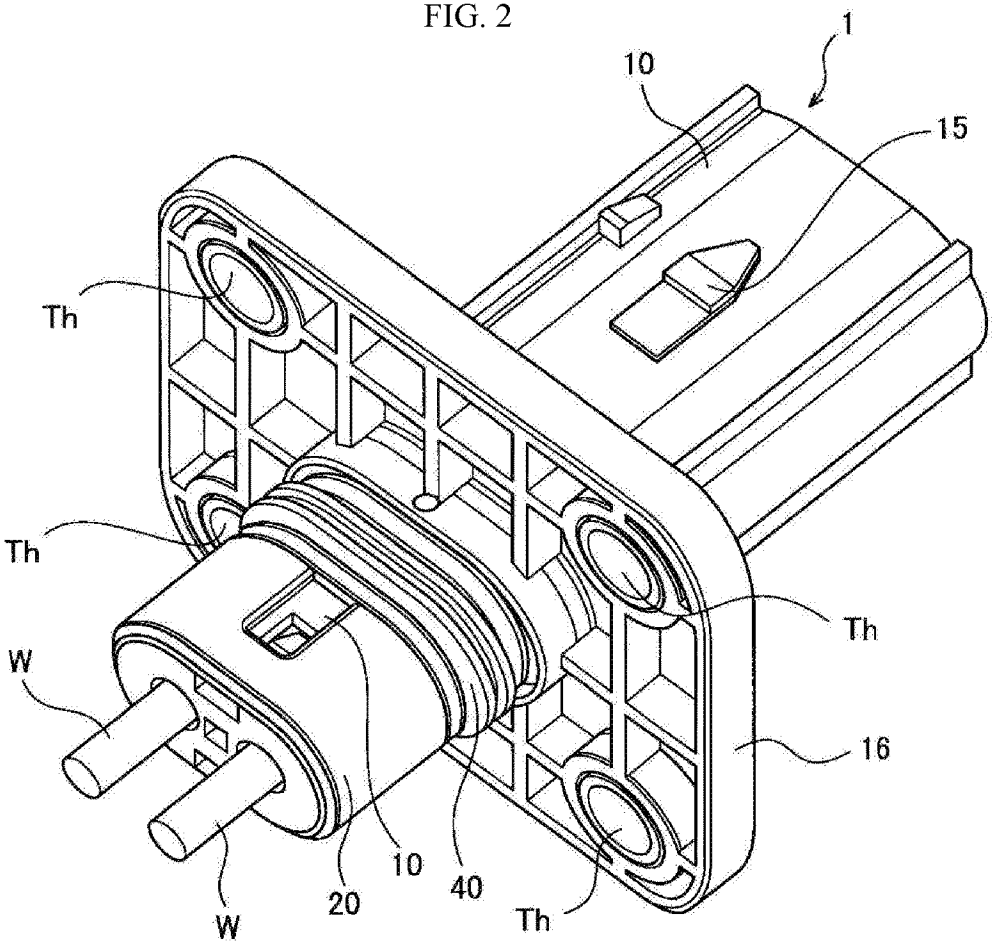
FIG. 2 is a perspective view of the shield connector for directly mounting on a device shown in FIG. 1.

FIG. 1 is a sectional view showing an attachment structure of a shield connector 1 for directly mounting on a device according to an embodiment of the present invention. FIG. 2 is a perspective view of the shield connector 1 for directly mounting on a device shown in FIG. 1.

The attachment structure of the shield connector 1 for directly mounting on a device shown in FIG. 1 is provided with a casing C and the shield connector 1 for directly mounting on a device. The shield connector 1 for directly mounting on a device is attached to the casing C. The casing C serves to house a vehicle component (e.g., motor or inverter) that is installed in an electric vehicle, a hybrid vehicle, or the like and is made of a metal material to secure necessary shield performance. The casing C is formed with an opening O, and the shield connector 1 for directly mounting on a device is attached to the casing C by inserting it into the opening O. In the state of attachment to the casing C shown in FIG. 1, a tip-side portion, to be fitted into a mating connector (not shown), of the shield connector 1 for directly mounting on a device projects from the casing C.

As a rough configuration, the shield connector 1 for directly mounting on a device includes a connector housing 10, a rear holder 20, a shield shell 30, and a packing 40.

The connector housing 10 has a terminal housing portion 11 which is made of a non-conductive synthetic resin and houses a conductive male terminal T. The terminal housing portion 11 is positioned at a tip-side portion of the connector housing 10, projects outward from the casing C, and is generally shaped like an elliptical cylinder. When the mating connector is fitted with the connector housing 10, the male terminal T in the terminal housing portion 11 is connected to a female terminal (not shown) of the mating connector.

The connector housing 10 has a stepped portion 12 on the tip side of the terminal housing portion 11. The stepped portion 12 is a portion that is larger in diameter than the terminal housing portion 11 and to which a waterproof member (e.g., waterproof packing) of the mating connector is pressed and touched when fitted in the mating connector. Thus, the terminal housing portion 11 has such a structure that intrusion of water into it from the tip side of the connector housing 10 is prevented when it is fitted in the mating connector.

The connector housing 10 is formed with a wire insertion portion 13 inside the casing C as its rear end portion. The wire insertion portion 13 is a portion in which an electric wire W on which the male terminal T is crimped is inserted.

The rear holder 20 is a member which is attached to the wire insertion portion 13. In a state that the electric wire W having the terminal are inserted, the rear holder 20 is attached to the wire insertion portion 13. The packing 40 is prevented from coming off since the rear holder 20 is attached to the wire insertion portion 13.

The connector housing 10 has lances 14 which project inward from the inner wall of the connector housing 10. The lances 14 are cantilever-shaped arm pieces and are deformed elastically and thereby enable insertion of the male terminal T that is attached to the electric wire W when the male terminal T is inserted into the terminal housing portion 11 through the wire insertion portion 13. Upon completion of the insertion of the male terminal T that is attached to the electric wire W, the lances 14 recover elastically and their tip lock portions 14*a* come into contact with or brought close to rear end portions of the male terminals T to prevent the male terminals T from coming off the terminal housing portion 11.

Furthermore, the outer wall of the connector housing 10 is formed with a lock portion 15 which serves to prevent the mating connector from coming off when the connector housing 10 is fitted into the mating connector.

In addition, the connector housing 10 has an attachment plate 16 which is an approximately rectangular plate and extends outward. The attachment plate 16 is a portion to be attached to the casing C and is formed so as to extend parallel with a portion, surrounding the opening O, of the casing C. As shown in FIG. 2, through-holes Th are formed through the attachment plate 16 at positions close to its four corners, respectively. The through-holes Th are holes into which bolts are inserted when the attachment plate 16 is fastened to the casing C with the bolts, and are formed at such positions as to be registered with respective bolt holes H of the casing C. The connector housing 10 is fixed to the casing C by performing bolt fastening in a state that the through-holes Th of the attachment plate 16 are registered with the respective bolt holes H of the casing C.

The shield shell 30 is a metal cylindrical member that surrounds the terminal housing portion 11. In the embodiment, the shield shell 30 is buried in the connector housing 10 by insert molding. That is, the shield shell 30 is buried in and thus integrated with the connector housing 10 to establish a strong fixing relationship between them.

However, the present invention is not limited to the case that the shield shell 30 is integrated with the connector housing 10. The shield shell 30 may be merely attached to the connector housing 10. The term "attached" means that the shield shell 30 is attached to the connector housing 10 so as not to be separated from it; it suffices that the shield shell 30 be attached to the connector housing 10 so as not to be separated from it by, for example, holding the shield shell 30 between the connector housing 10 and the casing C or using another member.

The above shield shell 30 has a cylinder portion 31 and a contact piece 32. The cylinder portion 31 is approximately shaped like an elliptical cylinder so as to conform to the shape of the connector housing 10, and surrounds the terminal housing portion 11. A tip portion of the cylinder portion 31 is an exposed portion 31*a* that is exposed from the inner surface of the connector housing 10. The exposed portion 31*a* extends to the tip side past the stepped portion 12 of the connector housing 10, and serves to form a conductive contact with a shield shell of the mating connector when the mating connector is fitted with the connector housing 10.

The cylinder portion 31 is formed with openings 31*b* at top and bottom positions to prevent the shield shell 30 from coming off the connector housing 10 after insert molding. The openings 31*b* are filled with resin when insert molding is performed.

Figure 3:
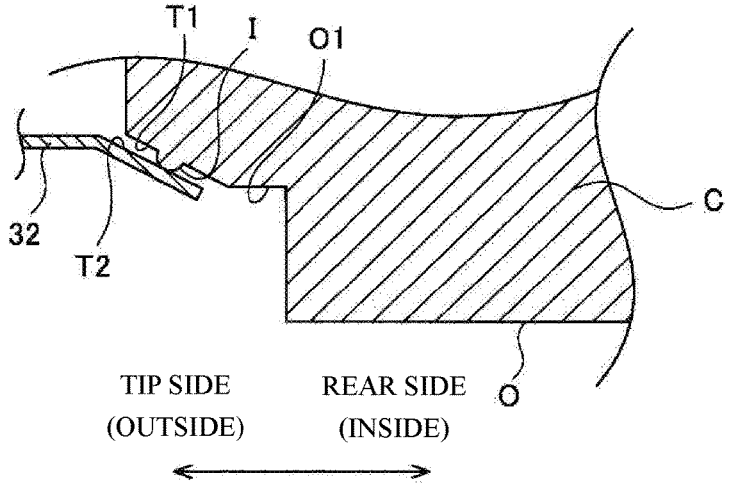
FIG. 3 is an enlarged sectional view near a contact piece shown in FIG. 1.

The contact piece 32 is positioned in a rear end portion of the shield shell 30 and serves as a contact to the casing C. FIG. 3 is an enlarged sectional view near the contact piece 32 shown in FIG. 1. In the example shown in FIG. 3, the opening O of the casing C is formed with a diameter-enlarged opening (diameter-enlarged portion) O1. The diameter-enlarged opening O1 is formed in an end portion of the opening O in an outside direction of the casing C. The diameter-enlarged opening O1 is formed with a tapered surface T1 at its tip end. The tapered surface T1 is a slant surface whose diameter decreases as the position goes inward in the casing C. In the tapered surface T1, a projection I is formed. A rear end portion of the contact piece 32 is bent so as to have a tapered surface T2. Like the tapered surface T1, the tapered surface T2 is a slant surface whose diameter decreases as the position goes inward in the casing C.

In the embodiment, the tapered surface T2 of the contact piece 32 comes into contact with the projection I of the casing C. Therefore, a portion, to come into contact with the casing C, of the shield shell 30 has the tapered surface T2. In particular, in the embodiment, at the time of bolt fastening, the tapered surface T2 comes into strong contact with the projection I and thereby a wedge effect is produced.

Figure 4:
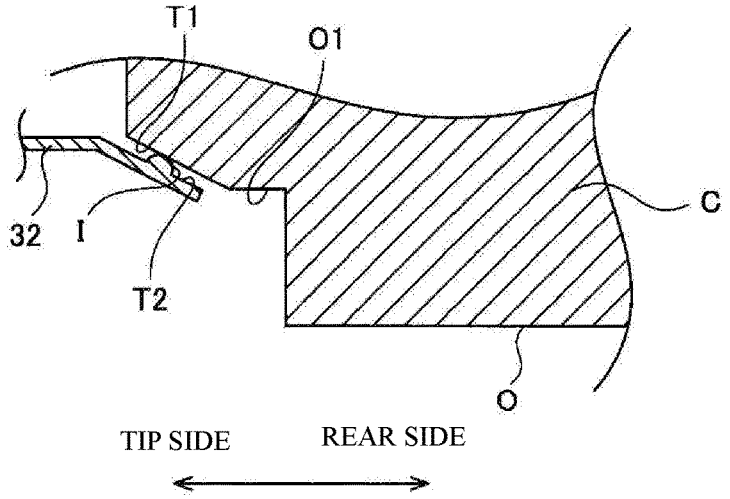
FIG. 4 is an enlarged sectional showing a first modification of the contact piece shown in FIG. 1.

FIG. 4 is an enlarged sectional view showing a first modification of the contact piece 32 shown in FIG. 1. As shown in FIG. 4, the tapered surface T1 of the casing C is not formed with a projection I and, instead, the tapered surface T2 of the contact piece 32A has a projection I. In this case, the projection I of the contact piece 32A comes into contact with the tapered surface T1 of the casing C. Since a portion, to come into contact with the shield shell 30, of the casing C is formed with the tapered surface T1, a wedge effect is produced at the time of bold fastening.

Figure 5:
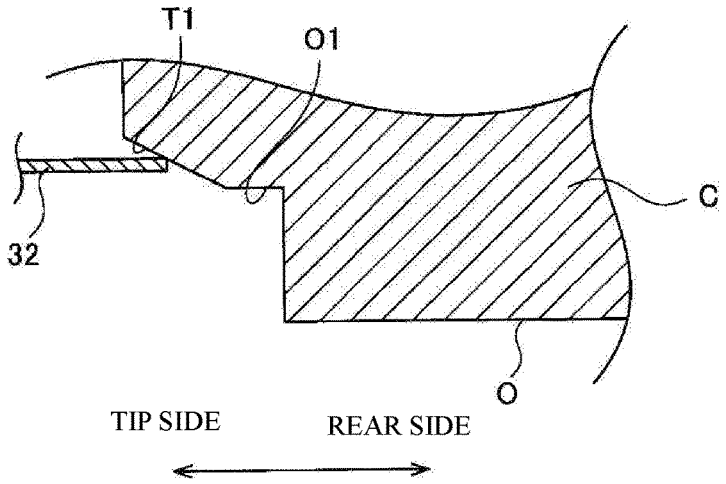
FIG. 5 is an enlarged sectional showing a second modification of the contact piece shown in FIG. 1.

FIG. 5 is an enlarged sectional view showing a second modification of the contact piece 32 shown in FIG. 1. As shown in FIG. 5, the contact piece 32 does not have a tapered surface T2 and is straight in a sectional view. On the other hand, the casing C is formed with a tapered surface T1 on its tip side. In this case, the contact piece 32 comes into contact with the tapered surface T1 of the casing C. Since a portion, to come into contact with the shield shell 30, of the casing C has the tapered surface T1, a wedge effect is produced at the time of bolt fastening.

Figure 6:
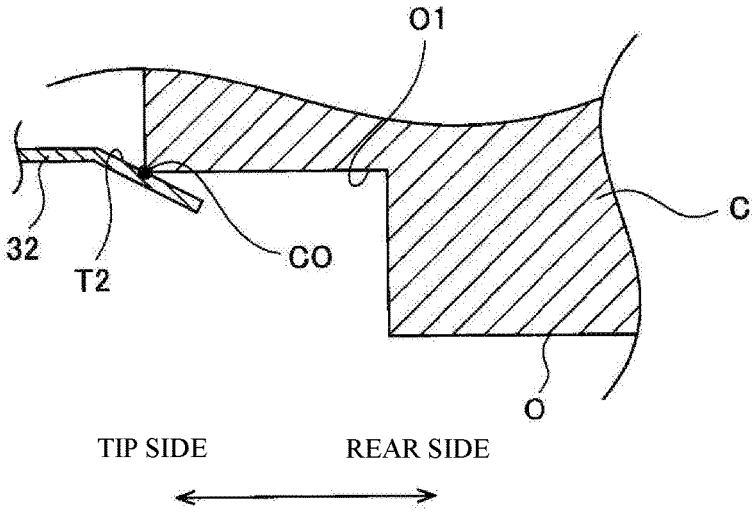
FIG. 6 is an enlarged sectional showing a third modification of the contact piece shown in FIG. 1.

FIG. 6 is an enlarged sectional view showing a third modification of the contact piece 32 shown in FIG. 1. As shown in FIG. 6, a rear end portion of the contact piece 32 is bent so as to have a tapered surface T2 that is not formed with a projection I. On the other hand, the casing C is not formed with a tapered surface T1. In this case, the tapered surface T2 of the contact piece 32 comes into contact with an edge CO (a tip edge of the diameter-enlarged opening O1). Since a portion, to come into contact with the casing C, of the shield shell 30 has the tapered surface T2, a wedge effect is produced at the time of bolt fastening.

Figure 7:
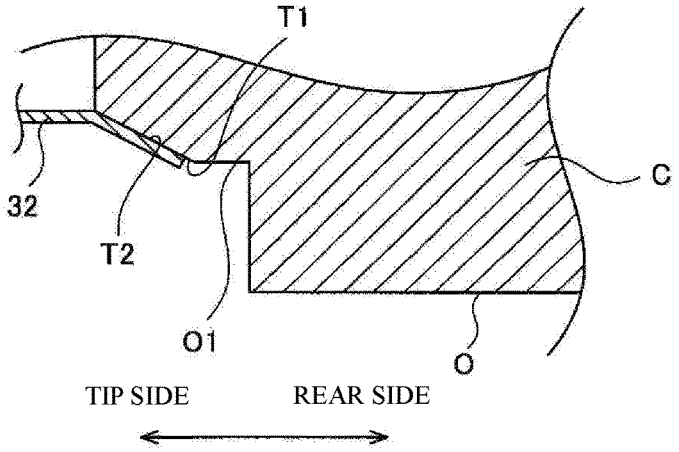
FIG. 7 is an enlarged sectional showing a fourth modification of the contact piece shown in FIG. 1.

FIG. 7 is an enlarged sectional view showing a fourth modification of the contact piece 32 shown in FIG. 1. As shown in FIG. 7, a rear end portion of the contact piece 32 is bent so as to have a tapered surface T2 that is not formed with a projection I. On the other hand, a tip end portion of thee casing C is formed with a tapered surface T1 that is not formed with a projection I. In this case, the tapered surfaces T1 and T2 come into contact with each other. Since a portion, to come into contact with what is opposed to it, of each of the shield shell 30 and the casing C has the tapered surface T2 or T1, a wedge effect is produced at the time of bolt fastening.

Figure 8:
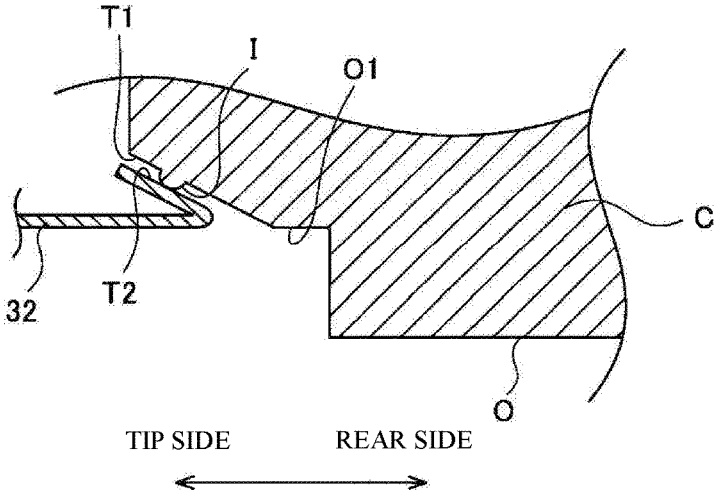
FIG. 8 is an enlarged sectional showing a fifth modification of the contact piece shown in FIG. 1.

FIG. 8 is an enlarged sectional view showing a fifth modification of the contact piece 32 shown in FIG. 1. As shown in FIG. 8, a rear end portion of the contact piece 32 is folded so as to have a tapered surface T2 that is not formed with a projection I. On the other hand, as in the case shown in FIG. 3, the diameter-enlarged opening O1 of the casing C is formed with, at its tip end, a tapered surface T1 having a projection I. Also in this case, the tapered surface T2 of the contact piece 32 comes into contact with the projection I of the casing C. Since a portion, to come into contact with the casing C, of the shield shell 30 has the tapered surface T2, a wedge effect is produced at the time of bolt fastening.

Figure 9:
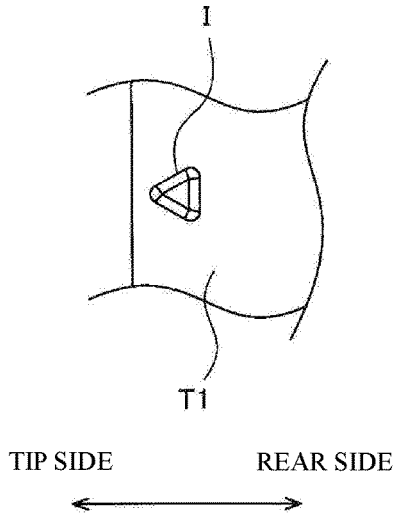
FIG. 9 is a plan view of a projection shown in FIGS. 3 and 8.

FIG. 9 is a plan view of the projection I shown in FIGS. 3 and 8. As shown in FIG. 9, the projection I which is formed on the tapered surface T1 of the diameter-enlarged opening O1 has, in a plan view, a tear drop shape (approximately triangular shape) that becomes narrower as the position goes toward the tip-side end. As a result, at the initial stage of contact between the projection I and the tapered surface T2 of the contact piece 32, the contact area is small. Further, the contact area increases as the contact proceeds to the final stage. This structure of the projection I makes it the necessary insertion force weaker at the initial stage of contact between the tapered surface T2 and the projection I.

FIG. 9 shows the shape of the projection I that is formed on the side of the casing C. Where the projection I is formed on the tapered surface T2 of the contact piece 32 as shown in FIG. 4, the projection I is formed so as to be directlyed to the opposite side to the side shown in FIG. 9. That is, the projection I is formed so as to have, in a plan view, a tear drop shape (approximately triangular shape) that becomes narrower as the position goes toward the rear-side end.

Again referring to FIGS. 1 and 2, the packing 40 is a rubber ring member, for example. The packing 40 serves to prevent water from intruding into the casing C through the gap between the opening O and the connector housing 10 when the shield connector 1 is attached to the opening O. More specifically, the packing 40 is disposed a little behind the attachment plate 16 of the connector housing 10. When the connector housing 10 is inserted into the opening O, the packing 40 is deformed elastically and brought into press-contact with the inner wall of the opening O.

Next, a method for attaching the shield connector 1 for directly mounting on a device according to the embodiment to the casing C will be explained.

First, a worker prepares an integrated body of the connector housing 10 and the shield shell 30, and inserts electric wires W to which respective male terminals T are attached through the wire insertion portion 13 of the connector housing 10. Thereby, the rear ends of the male terminals T are locked by the lances 14. After the rear ends of the male terminals T are locked by the lances 14, the worker attaches the packing 40 to the connector housing 10. Then the worker attaches the rear holder 20 to the wire insertion portion 13 of the connector housing 10. Subsequently, the worker inserts the connector housing 10 into the opening O of the casing C. At this time, since the packing 40 is brought into press-contact with the inner wall of the opening O, the connector housing 10 is in a tentatively fixed state. That is, in a state before bolt fastening (i.e., in a state that the tapered surface T1 and/or the tapered surface T2 has not been pressed against each other or what is opposed to it in each of the structures shown in FIGS. 3-7), the connector housing 10 inserted in the opening O is fixed to casing C tentatively because of the elastic force of the packing 40.

Figure 10:
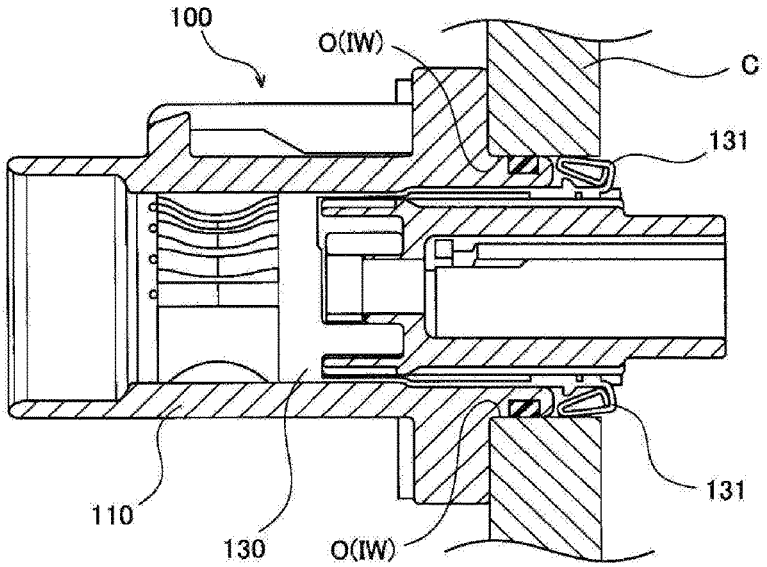
FIG. 10 is a sectional view of a shield connector for directly mounting on a device according to a comparative example.

In rendering the connector housing 10 in a tentatively fixed state by inserting it into the opening O, the insertion force can be so weak as to correspond to the press-contact of the packing 40. That is, unlike in a shield connector 100 for directly mounting on a device shown in FIG. 10, it is not necessary to bring the contact piece 131 into strong elastic contact with the inner wall IW of the opening O and hence the insertion force is not made unduly strong. As a result, the shield connector 1 for directly mounting on a device is increased in the efficiency of work of inserting the connector housing 10 into the opening O.

Subsequently, after confirming that the through-holes Th of the attachment plate 16 of the connector housing 10 are in registration with the respective bolt holes H of the casing C, the worker inserts bolts into the through-holes Th and the bolt holes H and fastening the bolts. At this time, a rotational force is produced around each bolt and acts on the shield connector 1 for directly mounting on a device.

However, in the embodiment and its modifications, even if a rotational force is produced by fastening each bolt, at least one of the tapered surfaces T1 and T2 comes into contact with what is opposed to it and produces a wedge effect. The contact piece 32 and the casing C come into strong contact with each other, and rotation of the connector housing 10 which is integrated with the shield shell 30 is prevented. When bolts have been screwed into all of the four through-holes Th of the attachment plate 16, the portion of the contact piece 32 is set in the diameter-enlarged opening O1 so as to be in contact with it, whereupon the attachment of the shield connector 1 for directly mounting on a device to the casing C is completed.

Also in the attachment structure of the shield connector 1 for directly mounting on a device according to the embodiment, it is preferable that the pressure of contact between the shield shell 30 and the casing C be high. As for this point, it can be said that a high contact pressure is secured in the embodiment by virtue of the wedge effect. In particular, where the projection I is formed in the contact portion, a proper contact pressure can be secured easily even if the displacement of the contact piece 32 is increased and the insertion stroke is shortened.

The step of inserting the electric wires W to which the male terminals T are attached in advance through the wire insertion portion 13 and the bolt fastening step may be executed in opposite order to the order described above.

As described above, in the shield connector 1 for directly mounting on a device according to the embodiment, the opening O has the diameter-enlarged opening O1 which is an outside-end opening of the casing C. The contact piece 32 which is an end portion of the shield shell 30 is set in the diameter-enlarged opening O1 of the opening O so as to be in contact with the diameter-enlarged opening O1 in a state that the shield connector 1 for directly mounting on a device is attached to the opening O of the casing C. Thus, the contact piece 32 comes into contact with the diameter-enlarged opening O1 only at the last stage of insertion of the shield connector 1 for directly mounting on a device into the opening O or at the time of bolt fastening. As a result, the efficiency of work of insertion of the shield connector 1 for directly mounting on a device into the opening O of the casing C can be made higher than in a case that the contact piece 131 is kept in press-contact with the opening O or the like all the time from the initial stage of the insertion to the bolt fastening.

The contact piece 32 has the tapered surface T2 formed in a part to be contact with the diameter-enlarged opening O1, and the diameter-enlarged opening O1 has the tapered surface T1 formed in a part to be contact with the contact pieces 32. Thereby, when the connector housing 10 is fixed to the casing C by bolt fastening, the tapered surface T1 is pressed against the taper surface T2. Since in this manner the tapered surface T1 or T2 is pressed against what is opposed to it utilizing the force of bolt fastening, a wedge effect is produced and the contact pressure at the contact portion can be made so high as to make the shielding effect stable. Furthermore, when the connector housing 10 is fixed to the casing C by bolt fastening, press-contact occurs by virtue of the wedge effect produced by the tapered surface T1 or T2, whereby during the bolt fastening the contact portion receives a strong pressing force and hence the connector housing 10 is prevented from rotation. Since the contact pressure at the contact portion is increased and the connector housing 10 is prevented from rotation, it is not necessary to use a member that is dedicated to stopping of rotation of the connector housing 10.

At least one of the contact piece 32 and the diameter-enlarged opening O1 is formed with the projection I which projects toward what is opposed to it. As a result, a proper contact pressure can be secured even if the displacement of the contact piece 32 is increased and the insertion stroke is shortened.

Although the invention has been described above by way of the embodiment, the invention is not limited to the above embodiment. Various modifications can be made without departing from the spirit and scope of the invention. Furthermore, if possible, other techniques can be combined with the embodiment as appropriate.

For example, although in the embodiment the male terminals T are housed in the terminal housing portion 11, the invention is not limited to this case; female terminals may be housed in the terminal housing portion 11.

Although in the embodiment the shield shell 30 is integrated with the connector housing 10 in such a manner that the former is buried in the latter by insert molding, the invention is not limited to this case; the shield shell 30 may be integrated with the connector housing 10 by inserting the former into a gap formed in the latter by press fitting. A further alternative structure is possible in which the shield shell 30 is composed of two components, one of which is integrated with the connector housing 10 by insert molding and the other of which is welded to the one component. Furthermore, instead of using insert molding or press fitting, the shield shell 30 may merely be attached to the connector housing 10.

REFERENCE SINGS LIST

1: Shield connector for directly mounting on a device
10: Connector housing
11: Terminal housing portion
30: Shield shell
32: Contact piece
C: Casing
I: Projection
O: Opening
O1: Diameter-enlarged opening
T1, T2: Tapered surface

The invention claimed is:

1. An attachment structure for directly attaching a shield connector to an opening formed in a metal casing comprising:

a shield connector for directly mounting on a device; and a metal casing having the opening, wherein the shield connector including:

a non-conductive connector housing inserted in the opening and having a terminal housing portion that houses a conductive terminal; and a metal shield shell which is attached to the connector housing and surrounds the terminal housing portion, wherein the connector housing is fastened to the casing with a bolt from outside the casing, wherein the opening has a diameter-enlarged portion formed in an end portion of the opening in an outside direction of the casing to be enlarged toward the outside direction, and wherein the shield shell has a contact piece at an end portion of the shield shell, and the contact piece is housed in and contacts with the diameter-enlarged portion in a state that the shield connector is attached to the opening.

2. The attachment structure according to claim 1, wherein one of the contact piece of the shield shell and the diameter-enlarged portion of the casing has a tapered surface formed in a part to be contact with the other of the contact piece of the shield shell and the diameter-enlarged portion of the casing, and the tapered surface of the one of the contact piece of the shield shell and the diameter-enlarged portion of the casing is pressed against the other of the contact piece of the shield shell and the diameter-enlarged portion of the casing when the connector housing is fixed to the casing by bolt fastening.

3. The attachment structure according to claim 1, wherein one of the contact piece and the diameter-enlarged portion has a projection which projects toward the other of the contact piece and the diameter-enlarged portion.

4. The attachment structure according to claim 1, wherein both of the contact piece of the shield shell and the diameter-enlarged portion of the casing have tapered surfaces, respectively, and the tapered surfaces come into contact with each other when the connector housing is fixed to the casing by bolt fastening.

* * * * *